US005451174A

United States Patent [19]

Bogursky et al.

[11] Patent Number: 5,451,174

[45] Date of Patent: Sep. 19, 1995

[54] SURFACE MOUNTED PINS FOR PRINTED CIRCUIT BOARDS

[75] Inventors: Robert Bogursky, Solana Beach; Kenneth P. Krone; Bengt E. Nyman, both of San Diego; Irwin Zahn, Coronado, all of Calif.

[73] Assignee: Autosplice Systems, Inc., San Diego, Calif.

[21] Appl. No.: 84,579

[22] Filed: Jun. 29, 1993

[51] Int. Cl.[6] ..... H01R 4/02

[52] U.S. Cl. ..... 439/876; 439/83

[58] Field of Search ..... 439/876, 78, 83

[56] References Cited

U.S. PATENT DOCUMENTS

| | | | |
|---|---|---|---|
| 4,066,326 | 1/1978 | Lovendusky | 439/876 X |
| 4,641,426 | 2/1987 | Hartman et al. | 439/876 X |
| 4,678,250 | 7/1987 | Romine et al. | 439/876 X |
| 4,968,263 | 11/1990 | Silbernagel | 439/246 |

FOREIGN PATENT DOCUMENTS

| | | | |
|---|---|---|---|
| 0394588A2 | 4/1989 | European Pat. Off. . | |
| 0828337 | 2/1960 | United Kingdom . | |
| 1540599 | 2/1979 | United Kingdom . | |
| 2009528 | 6/1979 | United Kingdom . | |
| 2153162 | 8/1985 | United Kingdom . | |
| 2209253 | 5/1989 | United Kingdom | 439/876 |
| 88/04839A1 | 6/1988 | WIPO . | |

OTHER PUBLICATIONS

I.B.M. Technical Disclosure Bulletin, vol. 35, No. 4B, Sep. 1992, pp. 464–465, "Pin Design for Attaching Pins to a Ceramic Package By Means of A Solder Without Solder Climb on the Pin Shank."

IBM Technical Disclosure Bulletin Mar. 1991 "Capillary Pin Head"vol. 33 No. 10B pp. 369–371.

*Primary Examiner*—Z. R. Bilinsky

*Attorney, Agent, or Firm*—Rosen, Dainow & Jacobs

[57] ABSTRACT

In order to allow header-less connector pins to be directly surface mounted to a PCB, using a standard pick and place machine, a novel pin holder is used to hold the pin while in pockets or holes of a reeled tape and during its pick and placement by the suction head of the pick and place machine supplied with the reel. The holder is configured to permit standard pin spacings of a row of pins to match standard female connectors, and to allow observation of the pin during the placement process. Novel pin designs for use with the holder are also described.

10 Claims, 8 Drawing Sheets

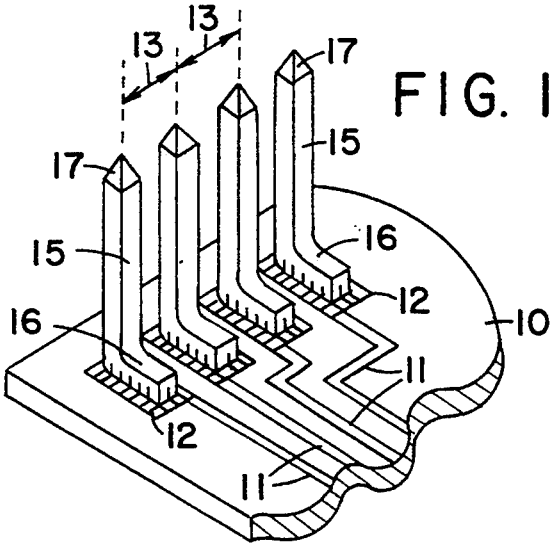
FIG. 1
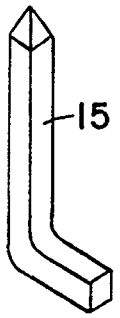
FIG. 4
FIG. 2A
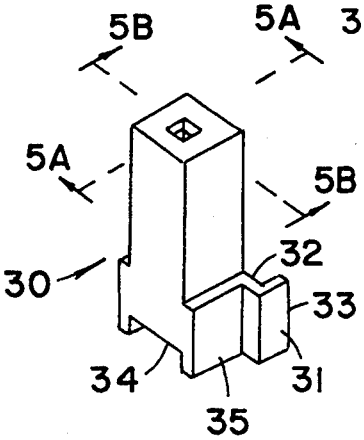
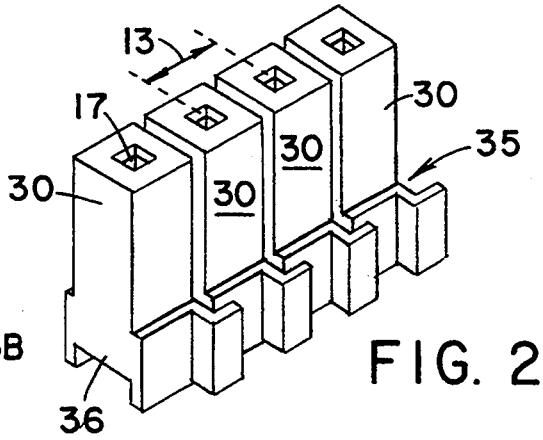
FIG. 2B
FIG. 3A
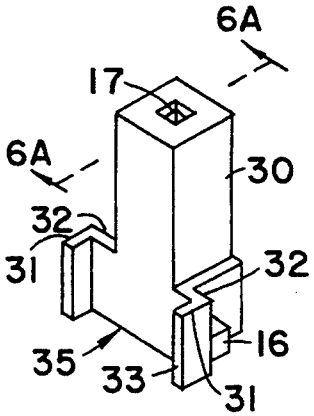
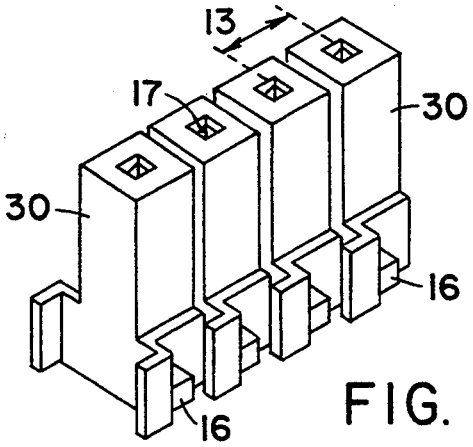
FIG. 3B FIG. 5A
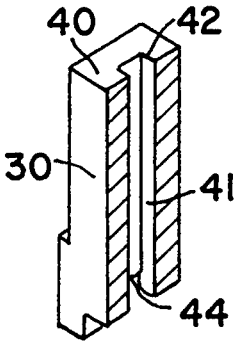
FIG. 5B
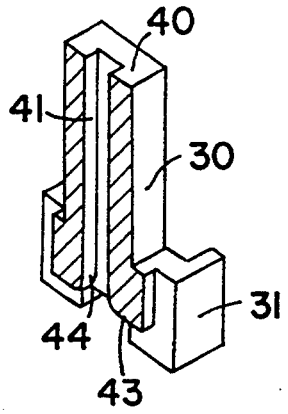
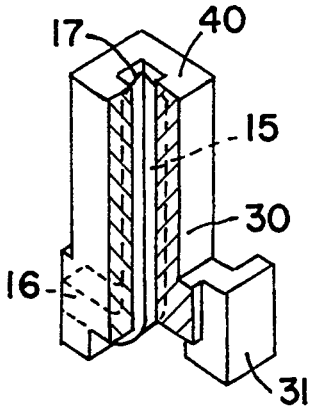
FIG. 5C
FIG. 6A
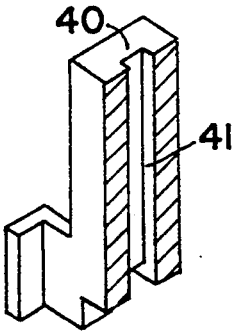
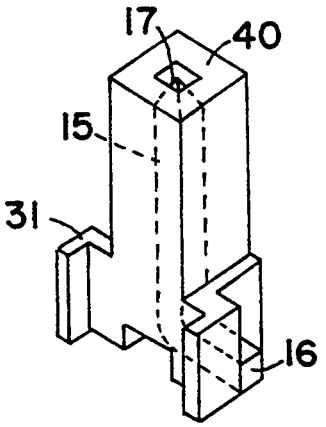
FIG. 6B
FIG. 6C
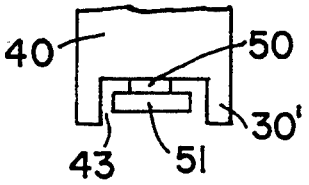
FIG. 6D
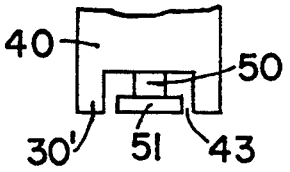

FIG. 7
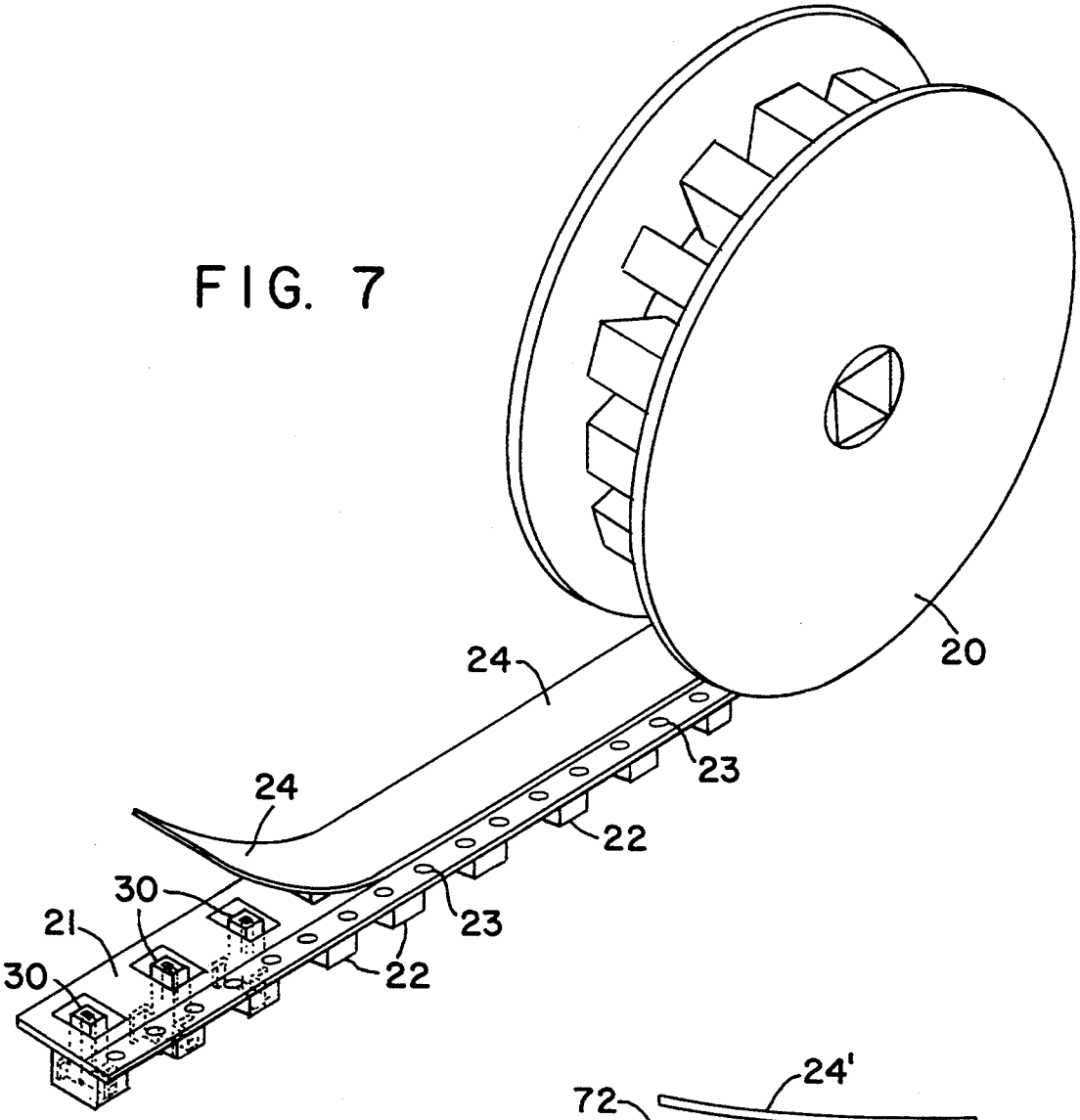
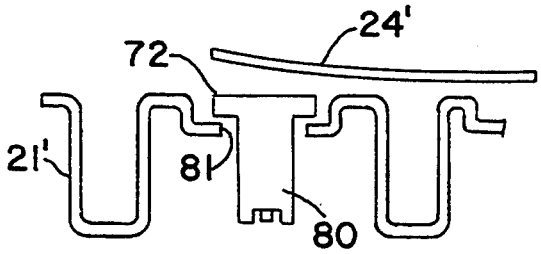
FIG. 7A

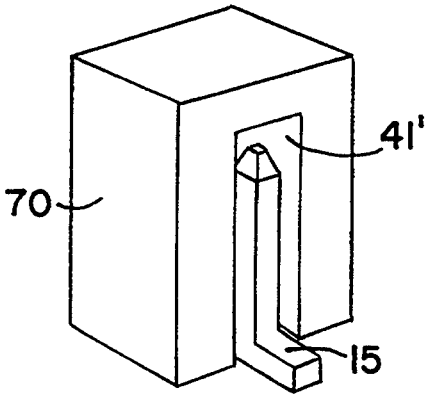
FIG. 10A
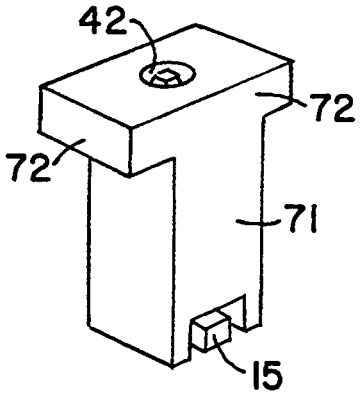
FIG. 10B
FIG. 10C
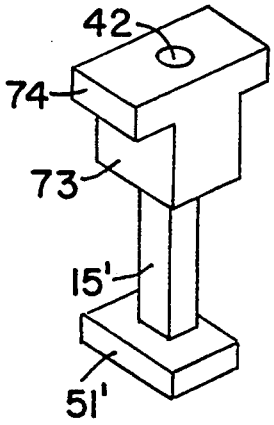

FIG. 10D
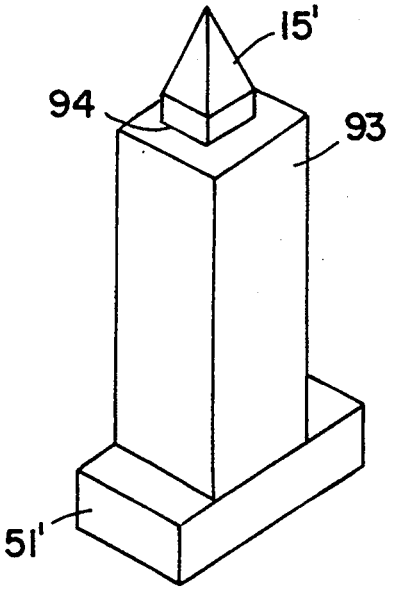
FIG. 10F
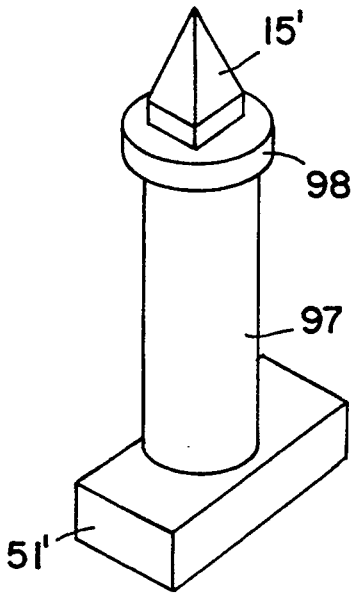
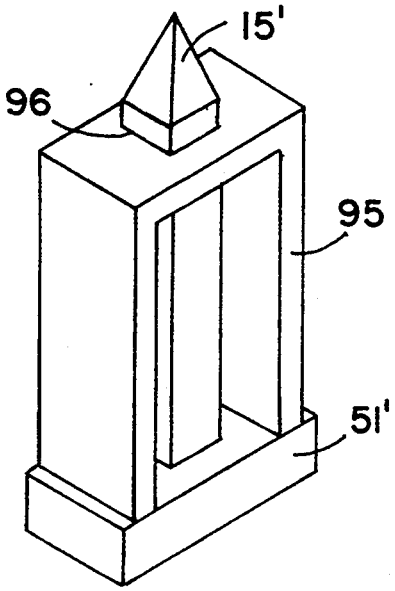
FIG. 10E
FIG. 10G
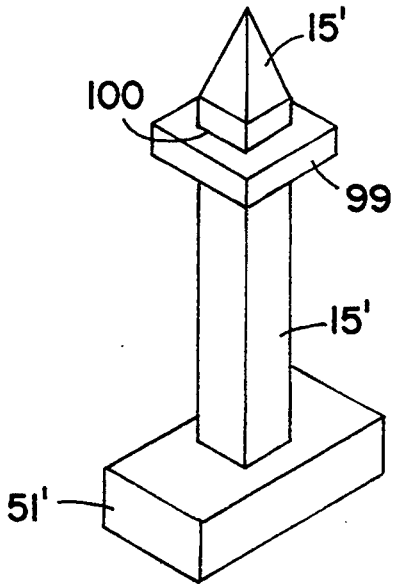

FIG. 11
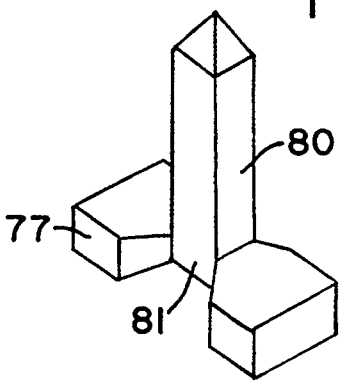
FIG. 13
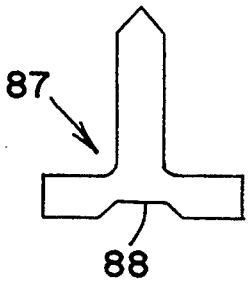
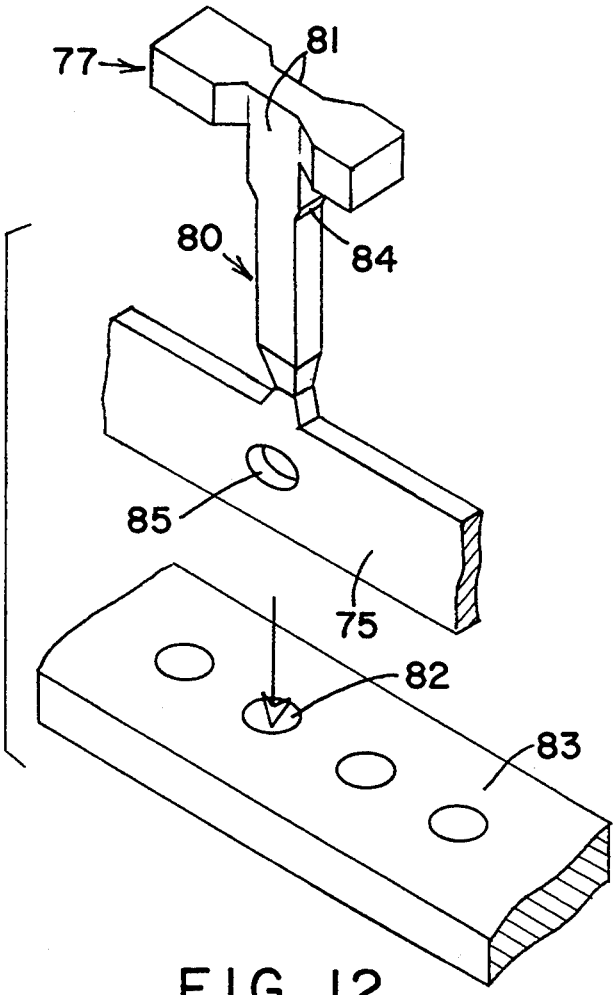
FIG. 12
FIG. 14
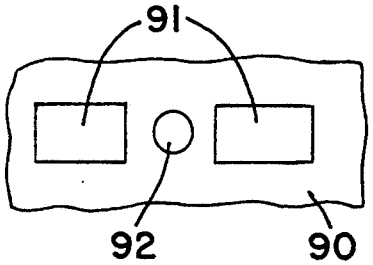

SURFACE MOUNTED PINS FOR PRINTED CIRCUIT BOARDS

This invention related to methods and apparatus for surface mounting pins to a substrate such as a printed circuit board (PCB).

BACKGROUND

Reference is made to an article by one of us entitled "Six (6) Easy Enhancements of Continuous Pin And Post Terminals", delivered at the Sept. 25–28, 1989 Coil Winding Proceedings Meeting at O'Hare Exposition Center, Rosemont, Ill., whose contents are herein incorporated by reference. This article describes state-of-the-art insertion machines for inserting into a PCB square, rectangular or round pins from a continuous supply of pre-notched, pre-starred pin material wound on a reel. These mounted pins, connected to the printed circuits, are used via female connectors for making external connections to the circuits on the PCB. The article also describes machine inserting into the PCB pin headers containing one or two rows of standard-spaced pins for receiving a multi-hole connector. With the increasing popularity of surface mounting of components, the article shows in FIG. 6 how to machine surface mount header-supported pins, with the header assuring the critical pin pitch uniformity for proper mating with the female connector. The pins are secured in place by bonding to the solder pads on the substrate, i.e., the surface of the PCB.

A popular technique to populate PCBs with components is to use a pick and place machine. The pick and place machine is typically provided with components seated in pockets in a plastic tape supplied from a reel, with the machine using a vacuum or suction head to pick a component from a pocket and place it, as directed by a computer, into its proper location on the PCB.

Attempts to use such standard machines to also pick and place header-supported pins has not, to our knowledge, been successful. A problem is that the same suction head that picks and places components, such a resistors, capacitors, and transistors or ICs, can not reliably pick up the header-supported pins. It is possible to build a machine that uses grippers, not suction, to pick and place header-supported pins, but then assembly costs would increase if two machines are needed to pick up suction and gripper placed components. Moreover, grippers may damage individual pins.

The common way of circumventing the problem is by hand mounting in the following manner. The portion of the pin below the plastic header is bent in alternating gull wing shape. In other words, if there were a four position SMT (surface mount technology) pin header, then the bottom portion of the first pin would be bent at 90 degrees to the left, the second pin would be bent at 90 degrees to the right, etc. This, is the common way of surface mounting pin headers to a board. This, of course, is more costly than machine mounting. Moreover, using a header to support and position the pins results in an assembly that when mounted makes for a higher profile when mated with a female connector. This can be undesirable for small packages. In addition, alternating bends use more space on a PCB.

SUMMARY OF INVENTION

An object of the invention is improved apparatus for machine placement of surface mounted connector pins.

Still another object is novel connector pin configurations for surface mounting to PCBs.

A further object of the invention is apparatus allowing a standard vacuum pick and place machine to pick up and place an individual connector pin or non-header-supported multiple pins for surface mounting to a PCB.

In accordance with one aspect of the invention, we provide a removable pin holder for receiving and holding a connector pin such that a laterally-extending bottom portion of the pin is exposed. The pin holder is configured such that an upper portion is adapted for being contacted and held by the standard suction head of a standard pick and place machine. In this way the suction head can pick up the holder with pin, and place it in the usual way on the PCB for attachment.

As a further feature of the invention, the holder bottom is configured to provide a stable base prior to soldering and to accommodate bent pin ends in various configurations.

Another feature of the invention is a holder configuration that allows an observer to determine whether the holder contains a pin.

Still another feature is that the holder is configured such that when multiple holders holding single pins are positioned alongside one another in a row, their pins, when soldered to the PCB, will have the correct pin pitch for reliable mating with a female connector.

By allowing pins to be mounted with pick and place machines enables many PCBs to be completely component assembled in one machine.

The end product produced by use of the invention will typically be a row of uniformly-spaced connector pins surface-mounted on the solder pads on a PCB, with the pin center line-center line spacing exactly matching the corresponding hole spacing in the female connector or the holes of another PCB, and without a header being needed to support the pins in that critical spacing.

In accordance with another aspect of the invention, a novel tape is provided to support individual pins with holders in such manner as to make it easy for use with a standard pick and place machine.

In accordance with still another aspect of the invention, novel pin configurations are provided that are especially adapted for surface mounting to a PCB. The pins are relatively simple and inexpensive to manufacture. They are provided with a relatively wide base which can be provided with recessed areas to simplify gripping by machine or for receiving excess solder paste or a cement.

The above and further objects, details and advantages of the present invention will become apparent from the following detailed description of preferred embodiments thereof, when read in conjunction with the accompanying drawings.

SUMMARY OF DRAWINGS

FIG. 1 is a perspective view of header-less surface mounted pins in accordance with the invention;

FIGS. 2A and 2B are a perspective view of one pin holder and a row of adjacent pin holders, respectively, in accordance with the invention;

FIGS. 3A and 3B are views similar to that of FIGS. 2A and 2B but from the opposite side;

FIG. 4 is a perspective view of a pin configured for surface mounting;

FIGS. 5A and 5B are cross-sectional views along the lines 5A—5A and 5B—SB, respectively, of FIG. 2A but with the pin removed;

FIG. 5C-is a partially sectioned perspective view of the holder of FIG. 2A with the pin in place;

FIG. 6A is a cross-sectional view similar to FIG. 5A of the holder of FIG. 3A;

FIG. 6B is a perspective view of the holder of FIG. 3A showing the pin on the interior;

FIGS. 6C and 6D are side views of the bottom of a pin holder with different sized recesses;

FIG. 7 is a perspective view of pin holders of the invention in a tape supplied from a reel for use in a standard pick and place machine;

FIG. 7A is a perspective view of part of a tape variant;

FIGS. 10A to 10G show in perspective other holder variants in accordance with the invention;

FIG. 11 is a perspective view of a preferred pin configuration in accordance with the invention;

FIG. 12 illustrates manufacture of the pin of FIG. 11 and its insertion in a header strip;

FIG. 13 is a side view of a variation of the pin of FIG. 11;

FIG. 14 illustrates mounting of a pin of the type shown in FIG. 13.

DETAILED DESCRIPTION OF PREFERRED EMBODIMENTS

Figure 8:
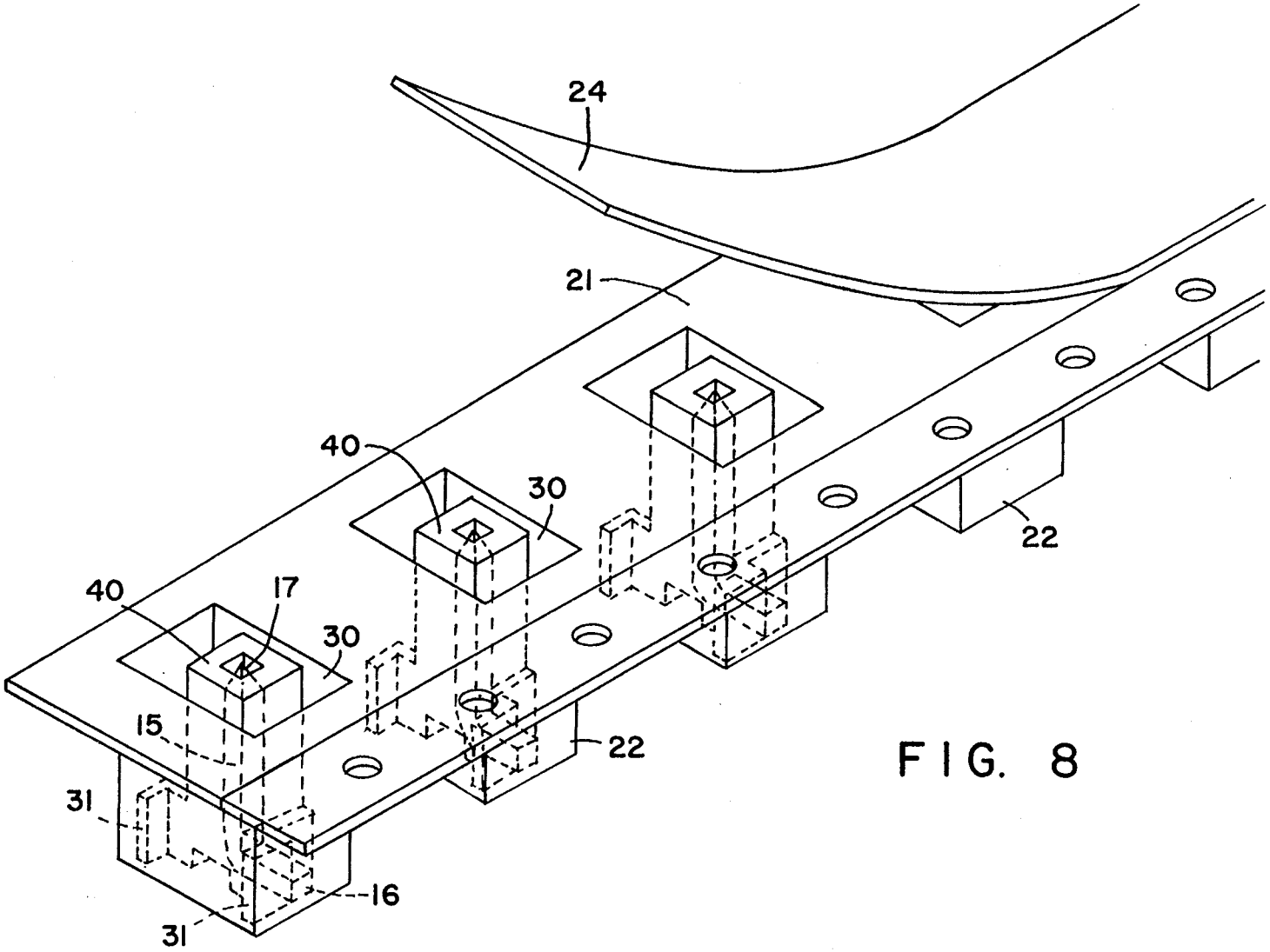
FIG. 8 is a enlarged view of a section of the tape of FIG. 7.

FIG. 1 shows one possible end product produced by carrying out the invention. A PCB 10 serving as a substrate has the usual laminated and etched conductors 11 leading to other surface-mounted components (not shown) and terminating in individual solder pads 12. To each of the solder pads 12 is soldered a connector pin 15. Each pin 15 is configured to have a lower bent or otherwise enlarged end portion 16 and a point or taper 17 at its upper end. The pins 15 form a row of uniformly-spaced pins, the center line-to-center line spacing being indicated by 13. That spacing 13 is selected to accurately match the corresponding spacing between the hole center lines of a standard female connector ! (not shown) adapted to mate with the row of pins 15 at their pointed ends 17. What is unique about the assembly shown is that it was machine mounted, and no pin header is present.

In particular, the assembly shown in FIG. 1 was made with a standard pick and place machine, for example, those supplied by Fuji, Panasert, Universal, Sanyo, and others, which employ a standard suction head designed to pick up components and place them on a PCB in accordance with a program-controlled computer. The machines are conventionally supplied with a feeder reel of components. As illustrated in FIG. 7, on a reel 20 is wound a plastic tape 21 which contains a series of pockets 22 for housing components. One edge of the tape 21 is supplied with a row of sprocket holes 23 for feeding the tape and aligning the pins with the vacuum pick-up head. The components inside the pockets 22 are prevented from falling out by a plastic cover tape 24, which is peeled off as shown during use to expose the underlying components in the pockets for access by the machine's suction head (not shown). The pick-up of the component from the tape and its alignment and placement on the PCB is conventional and need not be further described. Similarly, the soldering of the placed components (usually held in place by a drop of adhesive or solder paste) to the solder pads and traces by, for example, wave soldering or Infrared (IR) Reflow is also conventional and need not be further described. The invention concerns the manner of handling in such a machine connector pins as distinguished from the usual active and passive electrical components.

Since it was found virtually impossible for the suction head of the standard pick and place machine to pick up a pin 15 directly, a feature of the invention is to provide a removable pin holder for a single pin that can be picked up by the machine's standard suction head. One form of such a pin holder 30 is shown in FIG. 2A. The holder 30 comprises a generally vertically elongated member having stabilizing legs 31 at the bottom extending outwardly 32 from opposite sides and laterally 33 (rearwardly as viewed in FIG. 2A). At the front surface as viewed in FIG. 2A, at the base is provided a cutaway section or slot 34.

FIG. 2B shows a row of holders 30 placed in contact with one another by a pick and place machine. As will be noted, the legs 31 form a sort of seat or receptacle 35 for receiving the body portion 36 at the base of the adjacent holder 30. The dimensions of the body 30 are chosen such that, when aligned in a row as illustrated in FIG. 2B, the center line-to-center line spacing 13 of the pins held on the inside exactly matches that needed to mate with the connector. In effect, the row of nested holders acts as a temporary header to properly position the pins before and during the soldering operation.

FIGS. 3A and 3B are views similar to FIGS. 2A and 2B but from the opposite side, which also shows that the holders 30 can be positioned in the reverse manner should the location of other components interfere with the FIG. 2B position.

FIGS. 4–6D show further details of the holder's internal construction. The holder 30 has a generally flat top 40 providing sufficient surface area so that the suction head can easily pick it up. A hole 41 extends vertically through the body 30, terminating at the top in an opening 42 and at the bottom in an enlarged recess 43 exposed at the bottom. The hole 41 is sized to receive and hold by a press or interference fit the vertical part of the pin 15, so that when the holder 30 is pressed onto the pin and the holder lifted, the pin will be carried upward by the holder. The pin cross section can be rectangular, square or round. Alternatively, a small section of the vertical part of the pin can be enlarged to provide an interference fit that allows the pin to be carried by the holder. The height of the holder 30 is chosen so that the pin tip 17 is at or just below the surface 40 and is visible through the opening 42.

FIG. 5C shows in phantom one pin 15 inside the holder 30. The recess 43 at the bottom is sized to accommodate the bent end 16 of the pin 15 via a channel 44 passing to the outside, which prevents the pin from rotating within the holder 30. The height of the recess 43 is larger than or just matches the thickness of the pin end 16, so that the bottom surfaces of the pin end 16 is higher than that of the holder 30 to allow room for the solder pad and paste, or lies in substantially the same plane, as shown in FIG. 6D. FIG. 6C shows a pin base 51 above the holder bottom 30', and FIG. 6D shows where the two are substantially co-planar. The pins 50 depicted here are similar to Chat of FIG. 9A.

FIG. 7 shows the holders 30 each with a pin 15 seated in one of the tape pockets 22. The enlarged view of FIG. 8 provides more details. In this preferred embodiment, the top flat surface 40 of the holder 30 lies just below or at the top of the pocket 22, so that, when the cover tape 24 is lifted off, the holder 30 with pin 15 inside is easily picked up by the suction head in the same manner as any other component—the typical suction head usually only goes to the pocket surface, not inside—and thus can be automatically placed in its proper position on the PCB.

The tape 21 need not have walled pockets 22, though the latter are preferred. In the variant illustrated in FIG. 7A, holders 80 (with pins) of the type illustrated in FIGS. 10B and 10C, with shoulders 72, 74 can be supported in holes 81 in a tape 21', the overlying cover tape 24' preventing the holders 80 from falling out of the holes 81.

The holders 30 are preferably constituted of any high temperature plastic, for example, such as Polyphenylene Sulfide (PPS) or liquid crystal polymer (LCP), that can withstand the temperature of the reflow soldering, typically 230°–260° C. The holder 30 thus remains in place during the soldering process, and is removed and reused or disposed of after the pins have been soldered in place. The hole 42 on top may be used to observe the pin 15 inside to ensure all pins are in place before the soldering operation proceeds, and is close fitting to the pin to allow sufficient suction by the pickup head.

FIGS. 10A, 10B, and 10C show other holder configurations in accordance with the invention. In the FIG. 10A holder 70, the hole 41' is a slot, open at one side as shown. The holder 70 is adapted for side entry of the pin 15. No hole on top is necessary since the pin 15 can be observed through the open side. As before, the slot 41' dimensions provides an interference fit with the pin or a pin section.

The shape of the holder 71 in FIG. 10B provides a shoulder 72 to facilitate removal of the holder 71 following the solder operation. The FIG. 10C embodiment is adapted for IR soldering of the pin 15'. The holder 73 is a shortened version of that depicted in FIG. 10B with a shoulder 74. The shortened holder height allows it to accommodate various pin heights, eliminates the need for a holder base, since the holder 73 is held in place on the pin 15' by the friction fit, and avoids shielding the pin bottom from the IR heating rays. Also note that the modified holders in FIGS. 10A–10C lack the stabilizing legs 31 in FIGS. 5 and 6 since their bases can be shaped to stand alone, or are unnecessary as in FIG. 10C, and nesting of adjacent holders can be accomplished by other means. The pin 15' in FIG. 10 has a stand-alone base 51' similar to that of FIG. 9A.

With a pin 15' with a stand-alone base 51', other shapes of holders are also possible, which can be made of the indicated plastics or equivalents by extrusion or molding. Thus, FIG. 10D shows a holder 93 configured as a prism with a center hole 94 for receiving the upright portion of the pin 15' in a friction fit, and providing a larger surface area on top for the suction head. Fig. 10E shows an arrangement in which the holder 95 is U-shaped with two legs on the long sides of the pin base 51'. The holder 95 can also be rotated 90° and narrowed to fit on the shorter side of the base 51'. The friction fit is provided at the hole 96 in the bight portion of the U-configuration. In the FIG. 10F embodiment, the holder 97 has a cylindrical bottom part and a circular shoulder 98 at the top. The cylindrical bottom part can be shaped as a quadrangular prism. The holder 93 in FIG. 10D can also be made cylindrical. The holder 99 in FIG. 10G differs from the others in that it consists solely of a rectangular stiff cut-out from a plastic strip or sheet provided with the usual hole 100 for the friction fit support of the pin 15'. If desired, the strip-shaped part 99 can be circular as well as square or rectangular. In all four examples, an enlarged top surface is provided for suction pick-up, and the holder top part has a close fit with the pin top to preserve the suction (prevent leaks) when the suction head comes down on top to pick-up the holder carrying the pin for placement on the PCB or other substrate.

Figure 9A:
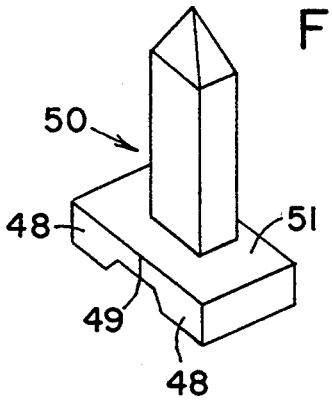
FIGS. 9A to 9G are perspective views of various pin configurations that can be employed in the invention.

FIGS. 9A to 9G depict modified forms of pins in accordance with a feature of the invention and that can be used with the holder of the invention, which however will require re-shaping of the bottom recess 43 and channel 44 to accommodate the differently-shaped base configurations. FIG. 9A shows a pin 50 having a square or rectangular base 51 for soldering to the solder pads 12 of the PCB.

A feature of the pin 50 is the provision of a recess 49 at the bottom of the base 51. When the pin 50 is used on a substrate to undergo reflow soldering, solder paste is used to hold the pin in place when in an upright position. The recess 49 serves to accommodate excess solder paste squeezed out when the pin is placed on the pads. Similarly, in wave soldering, the pin is usually upside down but held in place by a drop of adhesive, usually epoxy. The recess 49 acts as a convenient receptacle for the epoxy to prevent spreading to the adjacent contact areas 48.

Figure 9B:
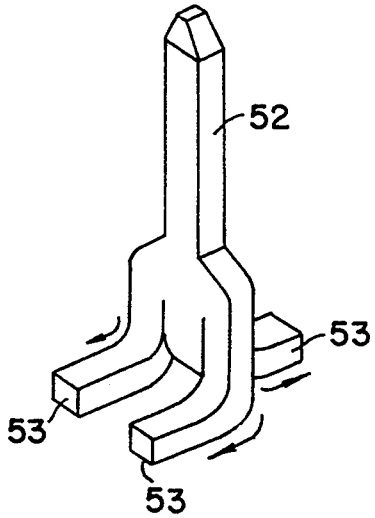
Figure 9C:
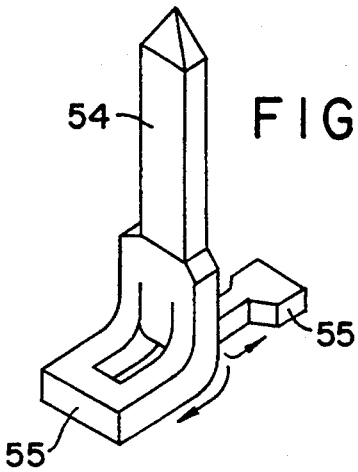
Figure 9D:
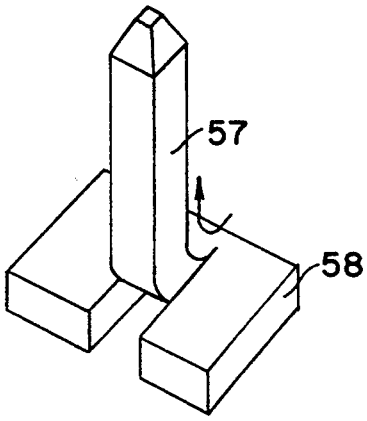

FIG. 9B shows a pin 52 that employs legs 53 extending in opposite directions, formed as shown by the arrows by bending out the bottom parts of a stamped configuration. FIG. 9C shows a pin 54 with another way of configuring the base legs 55. FIG. 9D shows a pin 57 with a base 58 somewhat similar to that of the pin of Fig. 9A. Again, after stamping out a flat piece, a center portion is bent upward, shown by the arrow, to form the upstanding pin portion 57 on the base 58. While in most cases, as illustrated, the pin portion extends perpendicular to the base, there may be applications where, due to space constraints, the pins are angled to the substrate, for example at 45° or at other angles.

Figure 9E:
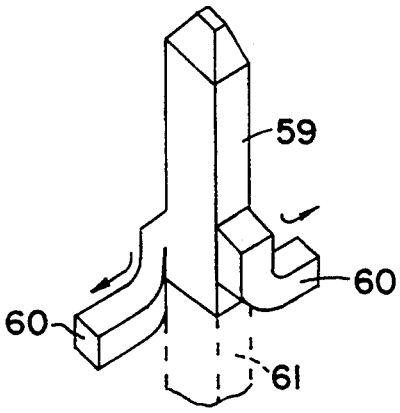
Figure 9F:
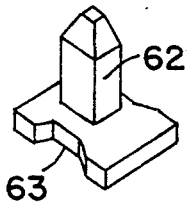
Figure 9G:
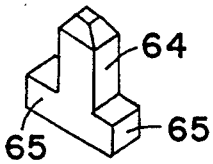

FIG. 9E shows a pin 59 with oppositely extending legs 60 with an in-line carrier post 61 for receipt in a center hole in the solder pad 12. FIG. 9F shows a pin 62 similar to that in FIG. 9A, except that recesses 63 are provided at the sides to allow adjacent components to be closer. FIG. 9G provides a pin 64 configuration in which the base comprises wing sections 65 on two sides, which again allows closer mounting of adjacent components. It will also be noted that when a pick and place suction head is to be used which fits over the upstanding pin position, it is desirable that the base area completely surrounds the pin so no suction is lost. The pins shown at FIGS. 9A and FIG. 9F have this feature.

The different base configurations also illustrate the different manufacturing techniques. For example, the FIG. 9A pin can be one-piece or assembled 2-pieces. The FIGS. 9B–9E pins are more easily made in one-piece by strip forming techniques involving stamping, bending and flattening operations. The bending operations are indicated by the arrows in each figure. It is readily easy to configure the bottom recess of the holder 30 to accommodate the different bases shown in FIGS. 9A–9G.

FIG. 11 shows a preferred one-piece pin configuration which has the feature of simple manufacture from a strip. In this case, from the strip are stamped out sections having a carrier part 75 (FIG. 12) which supports a plurality of pins 76, one only of which is shown in FIG. 12. The upper end is then cold-headed or otherwise configured into the bow tie shape shown at 77. The resultant pin 78, when separated from the carrier strip 75, is shown in FIG. 11, and comprises the usual upstanding part 80 attached to the bow tie base 77. The recesses 81 on opposite sides forms a gripping area when it is desired to insert the pin, by way of automatic machine pickup from the base side, pointed end first, into an aperture 82 in a conventional insulating header strip 83, shown by the arrow. The pin 80 is detached from the strip 75 before the insertion step. The ridge 84 can be provided to assist in holding the pin in the hole of the header 83. The recessed areas also act as convenient receptacles for excess solder paste when the pin base 77 is surface mounted. The hole 85 on the carrier strip is used for indexing the strip 75.

This pin configuration, with a thick, heavy, wide base, thus lends itself to efficient manufacture in a high speed progressive stamping die from a strip, and also allows selective plating, with for example solder at the base end and gold at the terminal pin end. Also, the bow tie shape of the base facilitates soldering.

FIG. 13 shows a modification 87 in which a recess 88, similar to 63 in FIG. 9F, is provided to serve as a receptacle for an epoxy dot. FIG. 14 shows part of a PCB 90 with spaced solder pads 91, with an epoxy dot 92 in the space between the pads 91. The pin 87 of FIG. 13 can be mounted on the PCB so that the recess 88 overlies and contacts the epoxy dot 92, with the adjacent land areas on the pin base seated on and contacting the solder pads 91. Such a configuration is useful for narrow stand-alone pins on close pin-to-pin centers.

When used with holders, after the pins have been inserted and located in their respective holders 30, each holder and pin is placed in a pocket of the tape, the cover applied and sealed, and the tape then wound onto a standard sized reel for distribution to PCB assemblers.

Pins can be used in single or multiple form not only as connector components but also as test points. Not only can holders be made to accommodate a right angle pin where required, but they also can be configured to accommodate a tab or lug (flat blade) to be surface mounted as well. Pins of the type described here are typically made of copper alloys, such as brass or phosphor bronze.

Summarizing, the benefits of the invention are:

Allows pins (without a plastic header, hence low profile and cost) to be surface mounted to a PCB;

By packaging the pins in a tape and reel format, the benefit is that the entire PCB can be populated with components with one pick and place machine. Moreover, in those applications where non-vacuum, gripper type pick and place machines are used, the holders will facilitate pickup of the pins and will avoid damage to the pins by the gripper.

The novel pin configurations, used with or without the holders, led themselves to low cost, high speed manufacture and the various base shapes are well adapted for gripper or suction pick-up and to accommodate solder or adhesive materials.

While the preferred application of the invention is pins surface mounted on PCBs, the invention is not limited to that application, and can be used where one or more pins are to be surface mounted on any kind of a substrate with or without conductive traces or other components.

Although there have been described what are at present considered to be the preferred embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A header-free electrical terminal pin for surface mounting on a substrate, said pin comprising;

(a) a stand-alone base portion, (b) an individual upstanding pin portion integral with and electrically connected to the base portion, (c) said base portion having a surface for soldering to the substrate and extending substantially in a given plane, said upstanding pin portion extending in a direction substantially perpendicular to said given plane and having opposite sides extending parallel to said substantially perpendicular direction, (d) said soldering surface extending at least around opposite sides of said upstanding pin portion, (e) said soldering surface having a recessed area for accommodating solder or adhesive paste.

2. The terminal pin of claim 1, wherein the pin portion has four sides and the base portion extends completely around all four sides of the upstanding pin portion.

3. An header-free electrical terminal pin for surface mounting on a substrate, said pin comprising:

(a) a stand-alone base portion, (b) an individual upstanding pin portion integral with an electrically connected to the base portion, (c) said base portion having a surface for soldering to the substrate and extending substantially in a given plane, said upstanding pin portion extending in a direction substantially perpendicular to said given plane and having opposite sides extending parallel to said substantially perpendicular direction, (d) said soldering surface extending at least around opposite sides of said upstanding pin portion, (e) said base portion and upstanding pin portion being constituted of one-piece metal and bent to extend in substantially orthogonal directions.

4. The terminal pin of claim 3, wherein the base portion comprises leg portions bent to extend out from opposite sides of the upstanding pin portion.

5. The terminal pin of claim 3, wherein the upstanding pin portion is bent to extend upward from the base portion.

6. A header-free electrical terminal pin for surface mounting on a substrate, said pin comprising:

(a) a bow-tie shaped stand-alone base portion, (b) an individual upstanding pin portion integral with the base portion, (c) said base portion having a surface for soldering to the substrate and extending substantially in a given plane, said upstanding pin portion extending in a direction substantially perpendicular to said given plane and having opposite sides extending parallel to said substantially perpendicular direction, (d) said soldering surface extending at least around opposite sides of said upstanding pin portion.

7. The terminal pin of claim 6, wherein the upstanding pin portion has a pointed end, and said soldering surface has a recessed area for accommodating solder or adhesive paste.

8. The terminal pin of claim 6, further comprising a ridged portion on the upstanding pin portion.

9. The terminal pin of claim 1, wherein the pin portion has a width parallel to the given plane, said base portion in the given plane having a width greater than that of the pin portion.

10. A header-free electrical terminal pin for surface mounting on a substrate, said pin comprising:

(a) a stand-alone base portion, (b) an individual upstanding pin portion integral with and electrically connected to the base portion, (c) said base portion having a surface for soldering to the substrate and extending substantially in a given plane, said upstanding pin portion extending in a direction substantially perpendicular to said given plane and having opposite sides extending parallel to said substantially perpendicular direction, (d) said soldering surface extending at least around opposite side of said upstanding pin portion.

* * * * *